US006530112B2

(12) United States Patent
Hirse

(10) Patent No.: US 6,530,112 B2
(45) Date of Patent: Mar. 11, 2003

(54) WRINGER BASKET FOR WET MOPS

(75) Inventor: Gernot M. Hirse, Frankfurt (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 09/994,970

(22) Filed: Nov. 26, 2001

(65) Prior Publication Data

US 2002/0108201 A1 Aug. 15, 2002

(30) Foreign Application Priority Data

Nov. 24, 2000 (DE) ..... 100 58 509

(51) Int. Cl.[7] ..... A47L 13/58
(52) U.S. Cl. ..... 15/260; 15/263
(58) Field of Search ..... 15/260, 263, 264

(56) References Cited

U.S. PATENT DOCUMENTS 1,814,413 A * 7/1931 Schulman
2,149,255 A * 3/1939 Fader
6,065,175 A * 5/2000 Tejerina

FOREIGN PATENT DOCUMENTS

| | | |
|---|---|---|
| DE | 195 03 572 | 7/1996 |
| FR | 1426827 | * 12/1965 |
| GB | 571259 | * 8/1945 |

* cited by examiner

*Primary Examiner*—Randall E. Chin
(74) *Attorney, Agent, or Firm*—Kenyon & Kenyon

(57) ABSTRACT

A wringer basket (1) for wet mops has a basket cone (6) that has a perforated basket cone bottom (3) and a basket cone wall (5) that rises from the latter on all sides, with slits. A subsequent basket edge (9) carries attachment elements (10) for setting the wringer basket (1) onto the edge of a bucket. The basket cone wall (5) has a convex curvature towards the inside of the basket cone (6), seen in cross-section. The outline of the basket cone (6) is oval shaped, at least in one portion of the basket cone (6).

10 Claims, 4 Drawing Sheets

WRINGER BASKET FOR WET MOPS

Figure 1:
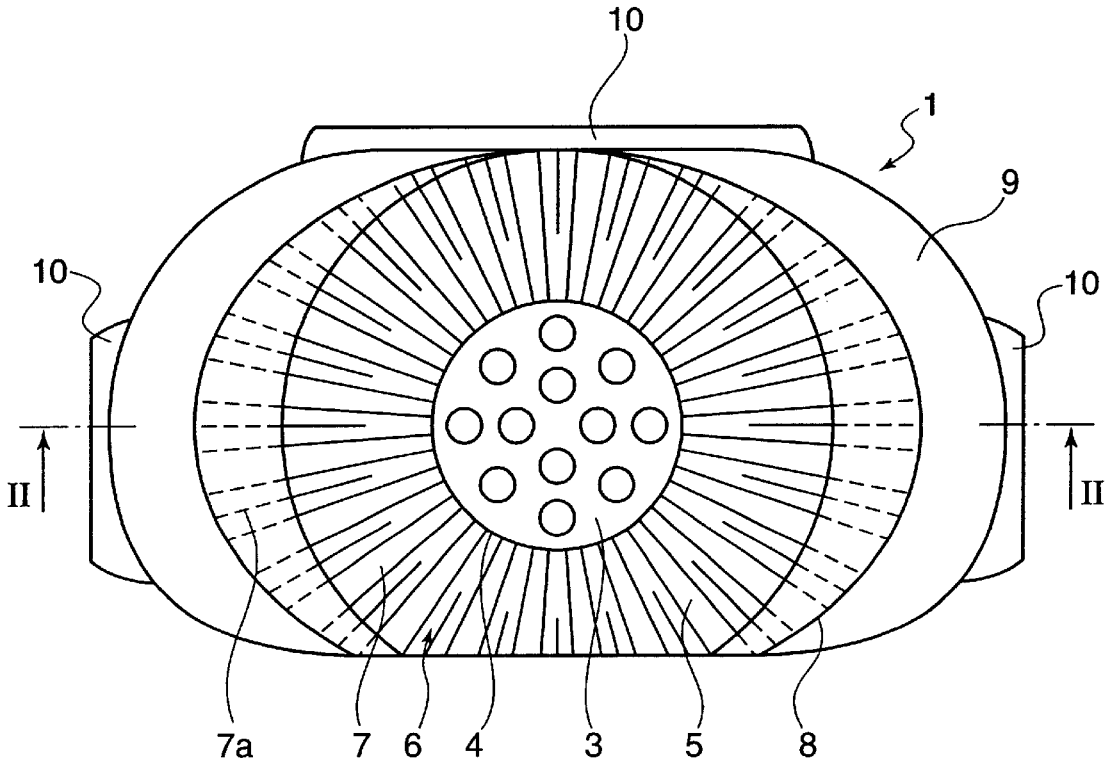

The invention relates to a wringer basket for wet mops, made up of a basket cone that has a perforated basket cone bottom and a basket cone wall that rises from the latter on all sides, with slits in at least part of the wall, a basket edge, and attachment elements for setting the wringer basket onto the edge of a bucket.

It is true that round mops can be wrung out, in simple manner, in perforated baskets set onto buckets, or in lever-activated wringers; however, they do not allow precise control on the floor, particularly in corners, narrow locations, on stairs, and in other locations that are difficult to access. Wet mops with an oblong outline shape are limited with regard to their movement possibilities, particularly also on stairs; increased effort is required for wringing them out.

The wet mops that are frequently used and are generally referred to as "spaghetti mops," with relatively long strands that hang down as a bundle, can, in a practical situation, only be guided over the floor area to be cleaned by using slinging movements. While it is true that large, open floor areas can be quickly cleaned, handling of the mop requires a lot of effort and is not ergonomically efficient. Also, the wet mop cannot be guided into narrow regions and corners, or only to an insufficient extent. These wet mops can only be wrung out in wringers, between compression plates, and are very predominantly used only in the commercial sector.

Such wringer baskets serve to wring out wet mops that are made up essentially of a bundle of strips, strands, or flaps of absorbent material, and have a mop head attached to a handle. The wet mop is pressed into the basket cone from above, so that the water is pressed out of the wet mop partially due to the compression effect, and partially as a result of a wringing process that results from a knot formation. In this connection, the basket wall that rises from the basket bottom on all sides serves to exert lateral pressure on the wet mop, as a result of the shape of the basket, which narrows towards the bottom, on the one hand; on the other hand, the basket wall is supposed to hold the wet mop in place in such a way that when it is twisted, a knot formation and therefore a wringing effect occurs. Known wringer baskets of the species stated initially (DE 195 03 572 C1) have ribs that project towards the inside, or depressions, in order to better hold the mop in place during a rotational movement, and to exert a stronger wringing pressure on the wet mop, by way of the basket cone wall, which for the remainder rises in a straight line. These known basket cones are therefore relatively narrow and deep; they therefore make it necessary to use a sufficiently deep water bucket, so that the bottom of the basket cone is not submerged in the water and, at the same time, a sufficiently large storage area for the water remains below the bottom of the basket cone.

Such high buckets are heavy and at risk of tipping over. In addition to the wringer basket that is suspended in the water bucket, however, a sufficiently large access area still has to be available so that the wet mop can be dipped into the water. The minimum dimensions of the water bucket that result from this make it difficult to securely suspend the wringer basket, which is relatively high and narrow for the reasons stated.

It is therefore the object of the present invention to structure a wringer basket of the species indicated initially in such a way that a good wringing effect is achieved at a low basket depth, for wet mops of different sizes, particularly also for oblong wet mops.

The object is achieved according to the invention, in that the basket cone wall has a convex curvature towards the inside of the basket cone, seen in cross-section.

This convex curvature of the basket cone wall has the result that the basket cone has a lesser cone angle in its lower region, adjacent to the bottom of the basket cone, because the basket cone wall rises relatively steeply here. In contrast, in the upper region, close to the edge, the basket cone is relatively flat, with basket cone walls that rise only slightly. This structure results in a good wringing effect, even with different sizes of wet mops. In particular, the knot formation for wringing out the wet mop is supported in this way, because the lower ends of the strips, strands, or flaps of the wet mop, which hang down, are effectively held in place in the narrow region of the basket cone, close to the bottom, and the basket cone walls with a convex curvature towards the inside subsequently exert a high lateral compression force on the wet mop.

Relatively large wet mops, particularly long ones, are also wrung out well, because their top region, adjacent to the mop head, is pressed against the upper region of the basket cone walls, where they rise at a low angle, because of the pressure effect exerted from the top, and wrung out there.

The structure of the basket cone walls according to the present invention makes it possible to structure the basket cone flat and broad, so that the wringer basket as a whole has only a slight depth and therefore does not require a particularly high water bucket. Instead, even in a normal or actually a relatively shallow water bucket, a sufficiently large area to hold the water is available below the bottom of the basket cone.

In accordance with an especially preferred embodiment of the invention, it is provided that the outline of the basket cone is oval, at least in certain parts.

Thus the transition from the conical region of the basket to the edge of the basket can lie on an approximately oval line. In addition, or instead, it can also be provided that the edge of the bottom of the basket cone is approximately oval.

This oval structure of the basket cone, at least in parts, results in a particularly good wringing effect in the case of a rotational movement of the wet mop to be wrung out.

It is particularly advantageous if the outline of the wringer basket is approximately an oblong, rounded rectangle, and attachment elements are provided at both narrow sides and one long side. This wringer basket can be affixed, in particularly space-saving manner, at the end of a water bucket that is rectangular in outline, where a sufficiently large access opening remains clear for dipping the wet mop into the bucket, next to the wringer basket. This water bucket can therefore be structured to be very small and light, so that its handling is significantly facilitated, also in the household sector. Oblong wet mops with a scrubber-like structure and handling can also be easily and efficiently wrung out.

Other advantageous further developments of the idea of the invention are the object of additional dependent claims.

The invention will be explained in greater detail below, using exemplary embodiments shown in the drawings.

Figure 2:
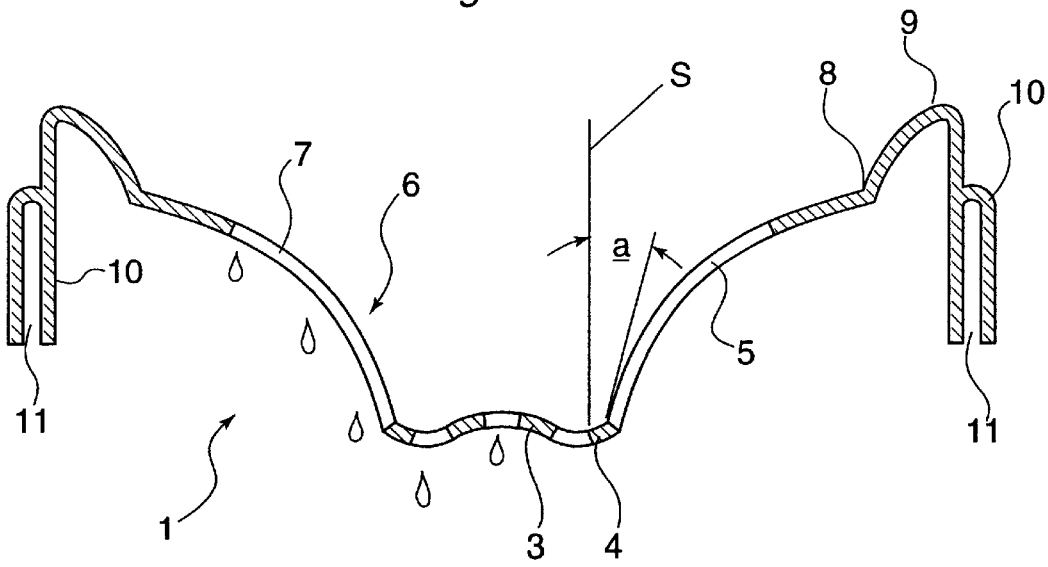
Figure 3:
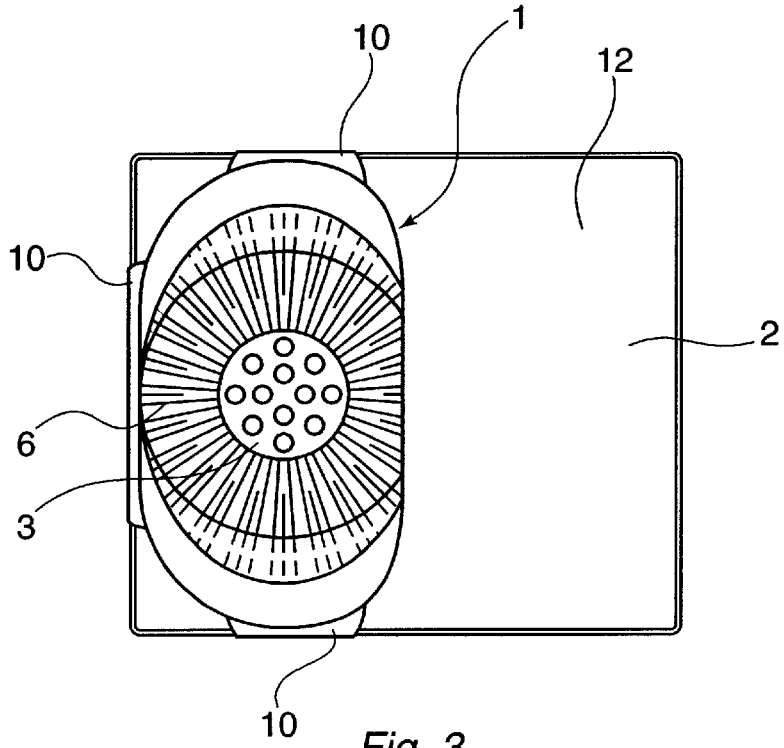
Figure 4:
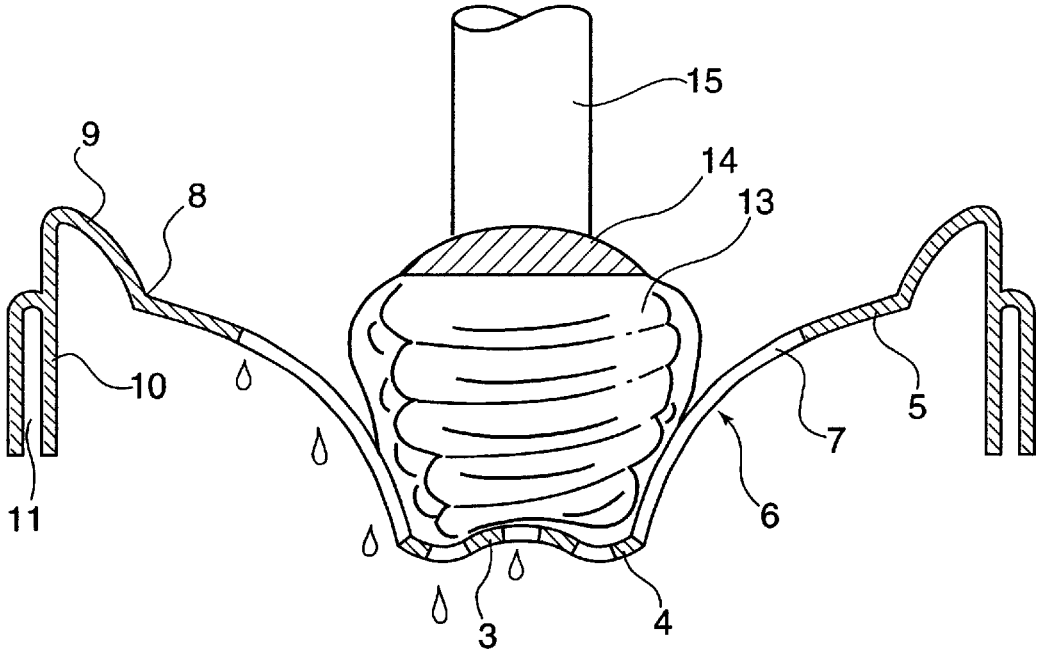
Figure 5:
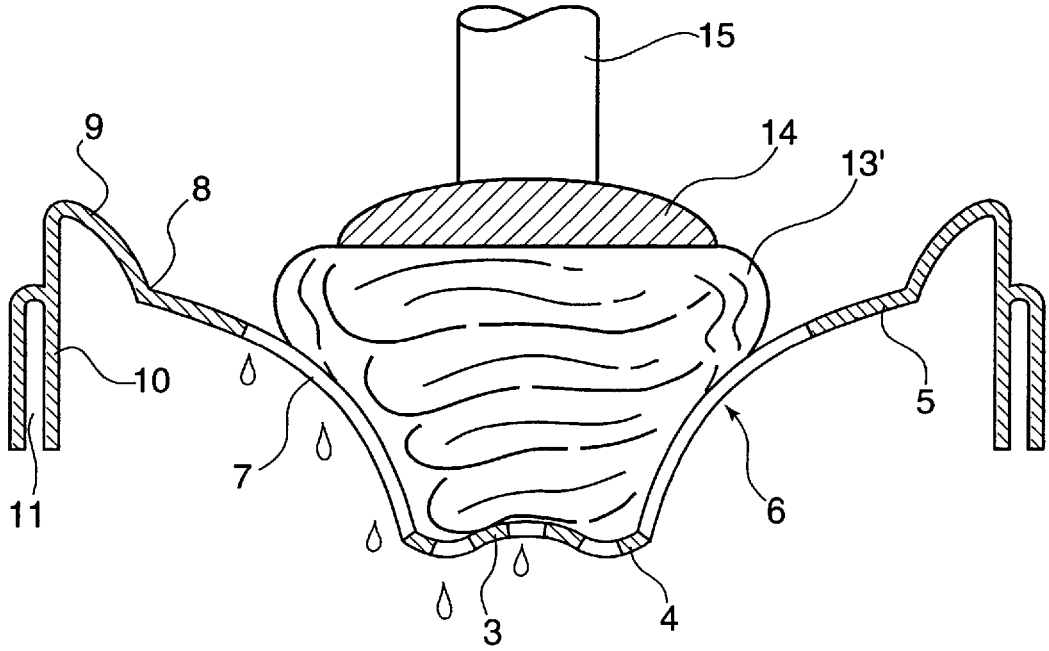
Figure 6:
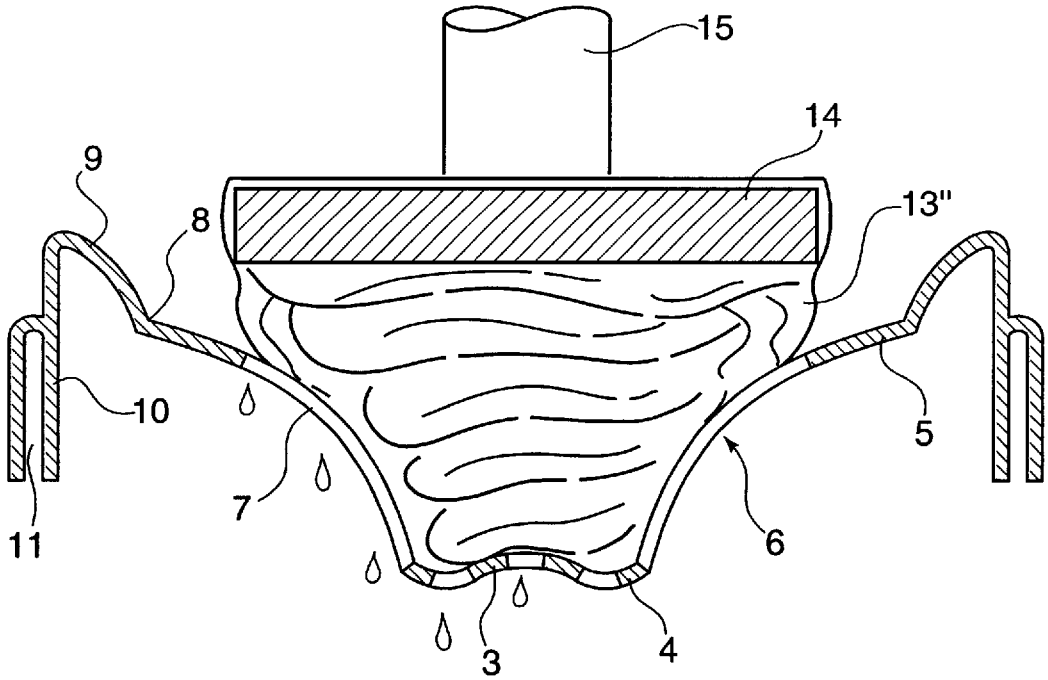
Figure 7:
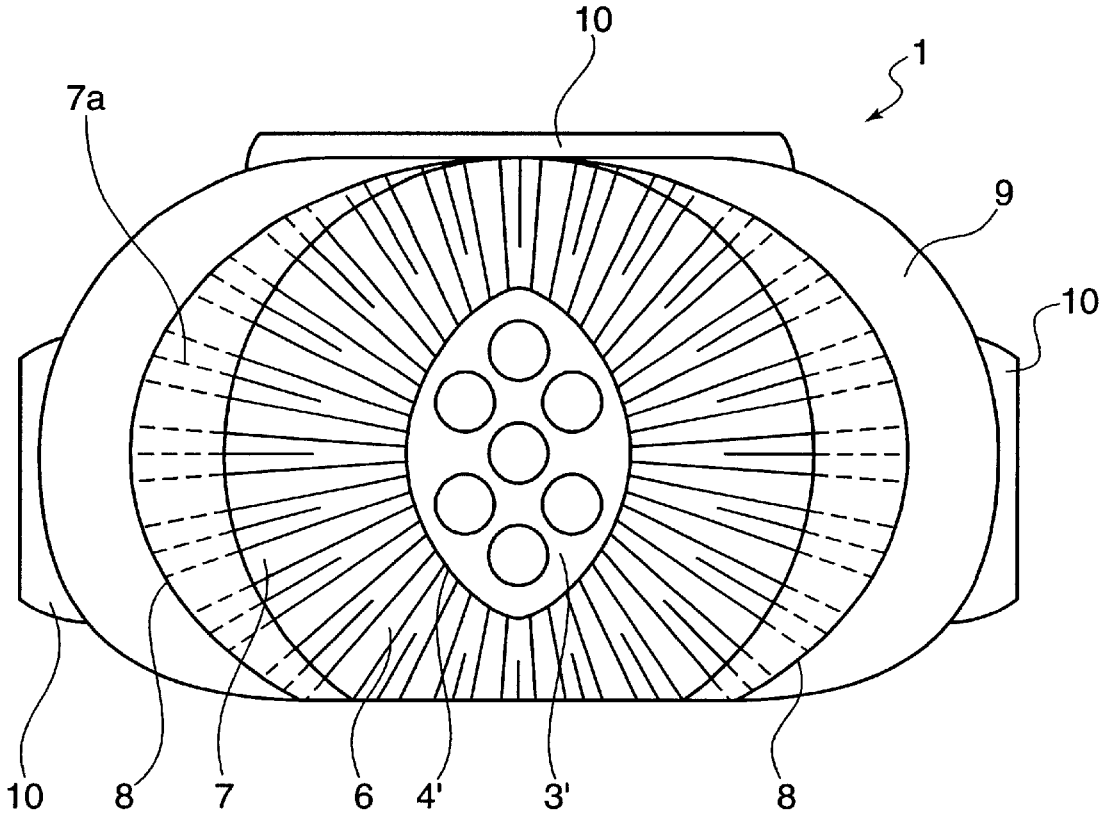

These show:

FIG. 1 a wringer basket for wet mops in a top view,

FIG. 2 a cross-section along line II—II in FIG. 41,

FIG. 3 in a top view, the wringer basket shown in FIG. 1 and 2 on a rectangular bucket, FIGS. 4, 5, and 6 in representations corresponding to FIG. 2, wringing processes with wet mops of different sizes, and FIG. 7 in a top view corresponding to FIG. 1, a modified embodiment.

Wringer basket 1 shown in FIG. 1 and 2 is made of plastic, in one piece. It is intended to be set onto a cleaning bucket 2 (FIG. 3), in order to wring out a wet mop (FIG. 4, 5, and 6).

Wringer basket 1 has a perforated, essentially circular basket cone bottom 3 that is slightly curved upward in its center region. A circumferential basket cone wall 5 rises up and out from circular edge 4 of basket cone bottom 3. Basket cone bottom 3 and basket cone wall 5 form a basket cone 6, which widens increasingly from the bottom to the top. Basket cone wall 5, which is provided with openings, such as slits 7, and possibly with ribs 7*a,* has a convex curvature in cross-section (FIG. 2), towards the interior of basket cone 6.

In the preferred exemplary embodiment shown, basket cone wall 5 rises from edge 4 of basket cone bottom 3 at an angle of incline a of less than approximately 20° relative to the perpendicular S, towards the outside. Angle of incline a increases to at least 60° relative to the perpendicular by the point where outer edge 8 of basket cone wall 5 is reached. Basket cone wall 5 is therefore closer to perpendicular in its lower region, close to the bottom, while in its upper region, close to the edge, it more closely approximates the horizontal.

Edge 8 of basket cone 6 formed in this way is followed by a basket edge 9, which rises more steeply from edge 8 of basket cone wall 5 than edge 8 rises from cone wall 5.

In the exemplary embodiment shown in FIG. 1–6, edge 8 that forms the transition from basket cone 6 to basket edge 9 lies on an approximately oval line. The outline of wringer basket 1 is approximately an oblong, rounded rectangle. Attachment elements 10 with attachment slits 11 that are open towards the bottom and fit onto the edge of bucket 2 are arranged on both narrow sides and one long side of the rounded rectangle that is formed in this way. As is evident from FIG. 1, basket edge 9, which follows basket cone 6, tapers and discontinues at least on one of the two long sides, actually on both long sides in the exemplary embodiment shown.

The depth of basket cone 6 is less than or approximately equal to half the width of basket cone 6. This flat, broad shape of the basket cone makes it possible to use a bucket 2 with only a relatively small depth, which is therefore particularly stable. As a result of the narrow outline shape of wringer basket 1, a sufficiently large access opening 12 remains in bucket 2, next to wringer basket 1, through which a wet mop can be dipped into bucket 2.

FIG. 4, 5, and 6 show wringing of three different wet mops 13, 13', and 13", respectively, with different sizes and widths; each of them is connected with a mop handle 15 by a mop carrier 14.

Wet mop 13, 13', or 13" is pressed into basket cone 6 from above and twisted at the same time. The lower segment, formed by the ends of strips, strands, or flaps of wet mop 13, 13', or 13", which hang down, is clamped in place, in each instance, between the regions of basket cone wall 5 that are close to the bottom, as a result of the small angle of incline a (FIG. 2), and held there, so that the wet mop can be twisted to form a knot and thereby wrung out. At the same time, the regions of basket cone wall 5 that have a convex curvature towards the inside exert a compression effect on the wet mop that is advantageous for the wringing process.

Large and wide wet mops, in particular, such as wet mop 13" shown in FIG. 6, finally come to rest against the upper regions of basket cone wall 5, which rise only at a flat angle, and are wrung out there essentially also by the vertical compression force that is exerted. In the upper region, close to the edge, there is sufficient room available even for oblong and/or larger mop heads.

FIG. 7 shows a modified embodiment of wringer basket 1, with an outline representation in accordance with FIG. 1, which essentially differs from the embodiment described above only in that edge 4' of basket cone bottom 3' is approximately oval. In this connection, its main axis (axis of the longest length expanse) lies at a right angle to the main axis (axis of the longest length expanse) of edge 8 of basket cone 6, which is also oval. In this way, an additional wringing effect is achieved during a rotational movement of the wet mop to be introduced into the basket.

What is claimed is:

1. A wringer basket for a wet mop, comprising: a basket cone that has a perforated basket cone bottom, a basket cone wall, sides, a basket edge, and attachment elements for setting the wringer basket onto the edge of a bucket, the basket cone wall rising from the basket cone bottom on all the sides of the basket cone, with slits in at least part of the wall, wherein the basket cone wall (5) has a convex curvature towards the inside of the basket cone (6), seen in cross-section, and the convex curvature is configured to exert a high lateral compression force on the wet mop.

2. The wringer basket according to claim 1, wherein the basket edge (9) rises more steeply from the edge (8) of the basket cone wall (5) than the edge (8) rises from the basket cone wall (5).

3. The wringer basket according to claim 1, wherein the depth of the basket cone (6) is less than or equal to half the width of basket cone (6).

4. A wringer basket for a wet mop, comprising: a basket cone that has a perforated basket cone bottom, a basket cone wall, sides, a basket edge, and attachment elements for setting the wringer basket onto the edge of a bucket, the basket cone wall rising from the basket cone bottom on all the sides of the basket cone, with slits in at least part of the wall, wherein the basket cone wall (5) has a convex curvature towards the inside of the basket cone (6), seen in cross-section, and wherein the basket cone wall (5) rises from the edge (4, 4') of the basket cone (6) at an angle of ascent (a) of less than 20° relative to the perpendicular (S), towards the outside, and the angle of ascent (a) increases to at least 60° relative to the perpendicular up to the edge (8) of the basket cone wall (5).

5. A wringer basket for a wet mop, comprising: a basket cone that has a perforated basket cone bottom, a basket cone wall, sides, a basket edge, and attachment elements for setting the wringer basket onto the edge of a bucket, the basket cone wall rising from the basket cone bottom on all the sides of the basket cone, with slits in at least part of the wall, wherein the basket cone wall (5) has a convex curvature towards the inside of the basket cone (6), seen in cross-section, and wherein a top view of the basket cone (6) is oval, at least in one portion of the basket cone (6).

6. The wringer basket according to claim 5, wherein the transition from the basket cone (6) to the basket edge (9) lies on an approximately oval line (8).

7. The wringer basket according to claim 5, wherein an edge (4') of the basket cone bottom (3') is approximately oval.

8. A wringer basket for a wet mop, comprising: a basket cone that has a perforated basket cone bottom, a basket cone wall, sides, a basket edge, and attachment elements for setting the wringer basket onto the edge of a bucket, the basket cone wall rising from the basket cone bottom on all the sides of the basket cone, with slits in at least part of the wall, wherein the basket cone wall (5) has a convex curvature towards the inside of the basket cone (6), seen in cross-section, and wherein the wringer basket further includes two narrow sides and two long sides, the top view of the wringer basket (1) is approximately an oblong, rounded rectangle, and the attachment elements (10) are arranged at both the narrow sides and one of the two long sides.

9. The wringer basket according to claim 8, wherein the basket edge (9) adjacent to the basket cone (6) is interrupted on at least one of the two long sides.

10. A wringer basket for a wet mop, comprising: a basket cone that has a perforated basket cone bottom, a basket cone wall, sides, a basket edge, and attachment elements for setting the wringer basket onto the edge of a bucket, the basket cone wall rising from the basket cone bottom on all the sides of the basket cone, with slits in at least part of the wall, wherein the basket cone wall (5) has a convex curvature towards the inside of the basket cone (6), seen in cross-section, and wherein the basket cone wall (5) is provided with ribs (7*a*).

* * * * *